US007328152B2

(12) United States Patent
Yang et al.

(10) Patent No.: US 7,328,152 B2
(45) Date of Patent: Feb. 5, 2008

(54) FAST BIT ALLOCATION METHOD FOR AUDIO CODING

(75) Inventors: Cheng-Han Yang, Pingjhen (TW); Hsueh-Ming Hang, Hsinchu (TW)

(73) Assignee: National Chiao Tung University, Hsinchu (TW)

( * ) Notice: Subject to any disclaimer, the term of this patent is extended or adjusted under 35 U.S.C. 154(b) by 752 days.

(21) Appl. No.: 10/879,615

(22) Filed: Jun. 28, 2004

(65) Prior Publication Data

US 2005/0228658 A1 Oct. 13, 2005

(30) Foreign Application Priority Data

Apr. 8, 2004 (TW) ..... 93109690 A

(51) Int. Cl.
*G10L 19/02* (2006.01)

(52) U.S. Cl. ..... 704/229; 704/500

(58) Field of Classification Search ..... 704/229, 704/500

See application file for complete search history.

(56) References Cited

U.S. PATENT DOCUMENTS

| | | | | |
|---|---|---|---|---|
| 5,956,674 | A * | 9/1999 | Smyth et al. | 704/200.1 |
| 6,487,535 | B1 * | 11/2002 | Smyth et al. | 704/500 |
| 6,937,770 | B1 * | 8/2005 | Oguz et al. | 382/235 |
| 2005/0165611 | A1 * | 7/2005 | Mehrotra et al. | 704/500 |

* cited by examiner

*Primary Examiner*—Daniel Abebe
(74) *Attorney, Agent, or Firm*—J.C. Patents

(57) ABSTRACT

A fast bit allocation algorithm for audio coding is disclosed. A virtual Huffman codebook model is referred in a trellis-based optimization approach to obtain a set of optimized scale factors, and then the set of optimized scale factors is referred in a trellis-based optimization approach to obtain a set of optimized Huffman codebooks. Therefore, the present invention can significantly reduce the amount of computation for the bit allocation. Further, according to the experimental data, the present invention can keep almost the same compression efficiency as the prior art JTB optimization. Hence, the present invention is more suitable for practical applications.

9 Claims, 1 Drawing Sheet

FAST BIT ALLOCATION METHOD FOR AUDIO CODING

CROSS-REFERENCE TO RELATED APPLICATION

This application claims the priority benefit of Taiwan application serial no. 93109690, filed on Apr. 8, 2004.

BACKGROUND OF THE INVENTION

1. Field of the Invention

This invention generally relates to an audio coding method, and more particularly to a fast bit allocation method for audio coding.

2. Description of Related Art

As the information technology advances, the transmission and storage of audio data are developed toward digitalization. To provide high quality audio transmission and storage, the audio data compression technology is the key technology to the audio data processing. In the traditional audio data compression such as the MPEG-1/2/4 standards and the Dolby AC3 standard, the bit allocation is an important part of the audio data compressor, which controls the compression bit rate and the distortion.

Generally, the input analog audio signal will be sampled to obtain the digitalized audio data. The sampling rate is, for example, 44.1 KHz or 48 KHz. The digital audio data is then divided into the frame data; each frame has 1024 audio samples for example. Then the transformation such as Discrete Cosine Transform (DCT) is applied so that the frame data is transformed from time domain to frequency domain to be the spectral coefficients. The spectral coefficients of each frame will be divided into several bands, which are also called scale factor bands (SFB).

Taking the MPEG-2/4 audio standard as an example, during the compression process, each band has a scale factor (SF) parameter to quantize the spectral coefficients. The SF parameter will affect the quantization error and the noise-to-masking ratio (NMR). The quantized spectral coefficients will be coded according to the Huffman codebook (HCB) parameter selected by each band to achieve the prescribed bit rate. In addition to the coding bits of the spectral coefficients, the differential codes of the SF parameter and the run-length codes of the HCB parameter will also affect the bit rate. The differential codes of the SF parameter and the run-length codes of the HCB parameter for the current band will be affected by the SF parameter and the HCB parameter of the previous band. Hence, it is necessary but very complex to optimize the SF parameter and the HCB parameter to achieve the best possible compression performance with the least compression distortion.

A prior art discloses the joint Trellis-based (JTB) optimization to determine the SF parameter and the HCB parameter simultaneously to minimize average NMR (ANMR) under the prescribed bit rate. See Aggarwal, S. L. Regunathan, K. Rose, "Trellis-based optimization of MPEG-4 advanced audio coding" Proc. IEEE Workshop on Speech Coding, pp. 142-4 2000. In addition, another article also uses JTB optimization to determine the SF parameter and the HCB parameter at the same time. See A. Aggarwal, S. L. Regunathan, K. Rose, "Near-optimal selection of encoding parameter for audio coding" Proc. Of ICASSP, vol. 5, pp. 3269-3272, June 2001. The difference is that, in addition to optimize the average ANMR, the latter also optimizes the maximum NMR (MNMR) under the prescribed bit rate.

Although the above articles can optimize the SF parameter and the HCB parameter at the same time to obtain almost the best compression efficiency, both require a large amount of computation. Hence, they are not suitable for the practical applications that have real-time and/or low-power requirements such as wireless communication systems.

SUMMARY OF THE INVENTION

The present invention is directed to a fast bit allocation method for audio coding to significantly reduce the amount of computation for the bit allocation without sacrificing compression efficiency in order to facilitate the practical applications.

The present invention provides a fast bit allocation method for audio coding, comprising: initializing a parameter $\lambda$; using a Trellis-based method to optimize the scale factor parameter in a condition of using the predetermined Huffman codebook to obtain a set of optimized scale factor parameter; using the optimized scale factor parameter and the Trellis-based method to optimize the Huffman codebook parameter to obtain a set of optimized Huffman codebook parameter; using the optimized scale factor parameter and the optimized Huffman codebook parameter to calculate a total bit rate required for coding; and adjusting the parameter $\lambda$ when the total bit rate is higher than a predetermined bit rate.

In an embodiment of the present invention, to modify the possible deviation of the scale factor parameter due to the use of the predetermined Huffman codebook, the method further comprises: using the optimized Huffman codebook parameter to optimize the scale factor parameter for adjusting the optimized scale factor parameter. Of course, from the reduction of the amount of computation point of view, this step could be neglected.

The present invention takes the MPEG-2/4 audio standard as an example and the predetermined Huffman codebook is a virtual Huffman codebook model. The virtual Huffman codebook model uses formulae as follows:

$$h_{k,i}^{v} = \{n \mid H_n(q_{k,i}) \le \min_m \{H_m(q_{k,i})\} + \delta\} \tag{1}$$

$$b_{k,i} = \frac{1}{|h_{k,i}^{v}|} \sum_{n \in h_{k,i}^{v}} H_n(q_{k,i}) + \alpha \cdot R_v(h_{l,i-1}^{v}, h_{k,i}^{v}) \tag{2}$$

where $\min_m\{H_m(q_{k,i})\}$ is a minimum number of bits required for coding the quantized spectral coefficients $q_{k,i}$, and the $\delta$ is a coding bit deviation coefficient. If coding bits $H_n(q_{k,i})$ satisfies the formula (1), the Huffman codebook n will be included in the virtual Huffman codebook $h_{k,i}^{v}$. In formula (1), $b_{k,i}$ is the bits for coding the quantized spectral coefficients, $$\frac{1}{|h_{k,i}^{v}|} \sum_{n \in h_{k,i}^{v}} H_n(q_{k,i})$$

is an average of total coding bits obtained by using all Huffman codebooks of the virtual Huffman codebook $h_{k,i}^{v}$, $R_v(h_{l,i-1}^{v}, h_{k,i}^{v})$ is the coding bits of the virtual Huffman codebook $h_{k,i}^{v}$, and $\alpha$ is a virtual Huffman codebook weighting coefficient.

When considering the ANMR optimization, the step of using the Trellis-based method to optimize the scale factor parameter comprises minimizing an unconstrained cost function $C_{SF_ANMR}$:

$$C_{\mathrm{SF_ANMR}} = \sum_i w_i d_i + \lambda \cdot (b_i + D(sf_i - sf_{i-1})),$$

where $w_i$ is a weighting number of the $i^{th}$ scale factor band, $d_i$ is a quantization distortion of the $i^{th}$ scale factor band, $\lambda$ is a Lagrangian multiplier, $b_i$ is the bits for coding the quantized spectral coefficients, and $D(sf_i\text{-}sf_{i-1})$ is scale factor coding bits of the $i^{th}$ scale factor band, which is the bits of the differential codes of the scale factor parameters.

When considering the MNMR optimization, the step of using the Trellis-based method to optimize the scale factor parameter comprises minimizing a cost function $C_{SF_ANMR}$ under a condition of $w_i d_i \leqq \forall i$:

$$C_{\mathrm{SF_MNMR}} = \sum_i b_i + D(sf_i - sf_{i-1}),$$

where $w_i$ is a weighting number of the $i^{th}$ scale factor band, $d_i$ is a quantization distortion of the $i^{th}$ scale factor band, $\lambda$ is a Lagrangian multiplier, $b_i$ is the bits for coding the quantized spectral coefficients, and $D(sf_i\text{-}sf_{i-1})$ is the scale factor coding bits of the $i^{th}$ scale factor band.

In addition, the steps of using the optimized scale factor parameter and the Trellis-based method to optimize the Huffman codebook parameter to obtain the optimized Huffman codebook parameter comprises minimizing an unconstrained cost function $C_{HCB}$:

$$C_{HCB} = \sum_i b_i + R(h_{i-1}, h_i),$$

where $b_i$ is the bits for coding the quantized spectral coefficients, and $R(h_{i-1},h_i)$ is the Huffman codebook coding bits of the $i^{th}$ scale factor band.

The above minimization of the unconstrained cost functions $C_{ANMR}$, $C_{HCB}$ and $C_{SF_MNMR}$ can be achieved by using a Viterbi search procedure.

In light of the above, the fast bit allocation method for audio coding of the present invention, in the condition of using the virtual HCB model, first uses the Trellis-based method to optimize the SF parameter to obtain an optimized SF parameter, and then uses the optimized SF parameter and the Trellis-based method to optimize the HCB parameter to obtain an optimized HCB parameter. Hence, the present invention can significantly reduce the amount of computation for the bit allocation. Further, according to the experimental data, the present invention can keep almost the same compression efficiency as the prior art of JTB optimization. Hence, the present invention is more applicable to the practical applications.

The above is a brief description of some deficiencies in the prior art and advantages of the present invention. Other features, advantages and embodiments of the invention will be apparent to those skilled in the art from the following description, accompanying drawings and appended claims.

DESCRIPTION OF EMBODIMENTS

Figure 1:
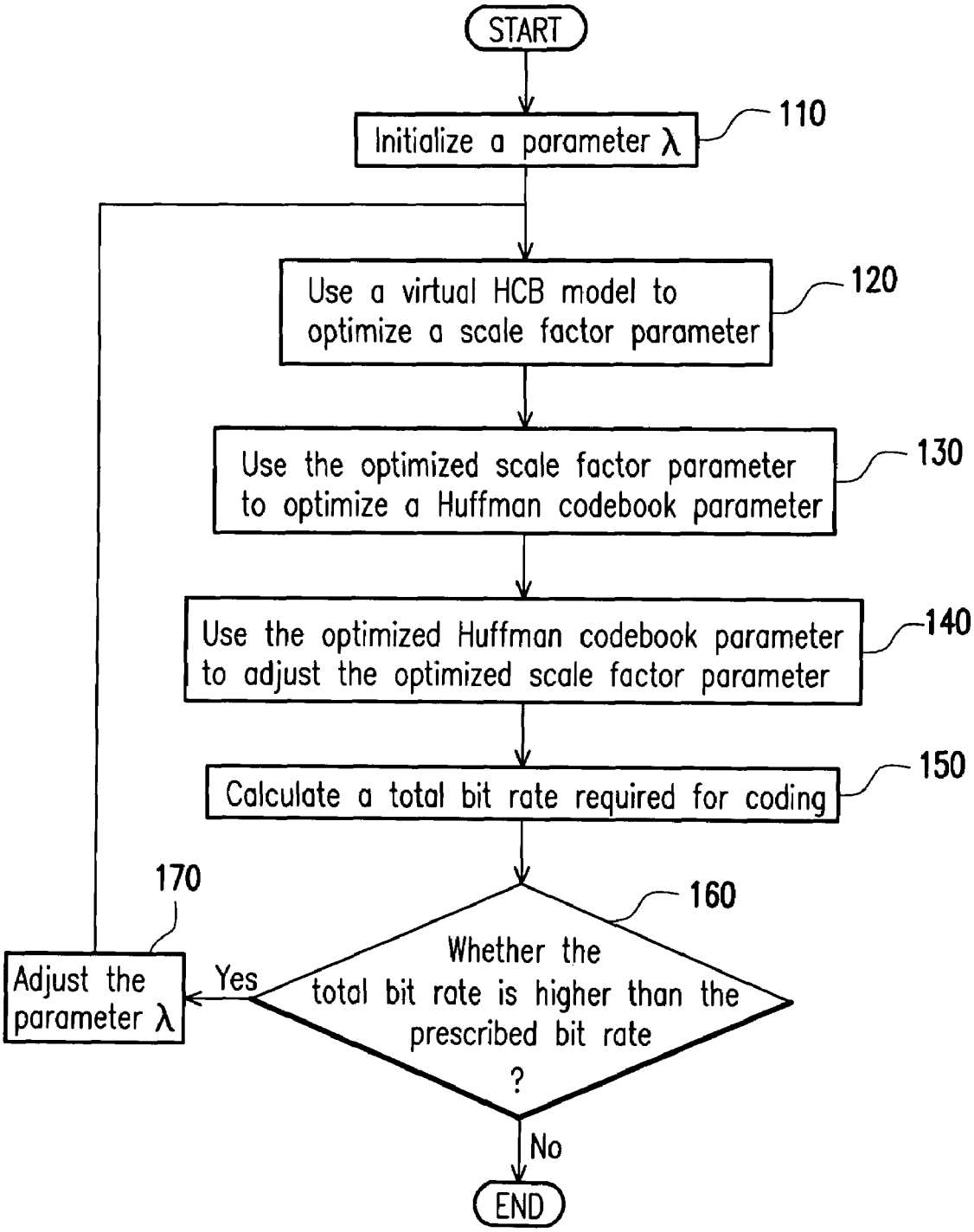
FIG. 1 is the flow chart of the fast bit allocation method for audio coding in accordance with an embodiment of the present invention.

As described above, in the traditional audio data compression such as the MPEG-1/2/4 standards and the Dolby AC3 standard, the bit allocation is an important part of the audio data compressor, which controls the compression bit rate and the distortion. The compression bit rate and the distortion are controlled by the SF parameter and the HCB parameter. The following description will take the Advanced Audio Coding (AAC) of MPEG-4 as an example to illustrate the relationship between the SF parameter and the HCB parameter and the compression bit rate and the distortion when optimizing the average Noise-to-Mask Ratio (ANMR), and the maximum Noise-to-Mask Ratio (MNMR) criteria. In addition, the analysis of the computation is processed in the condition of 60 SF candidate parameters and 12 HCB candidate parameters.

When optimizing the ANMR, the following formula has to be satisfied:

$$\min \sum_i w_i d_i \text{ such that } \sum_i (b_i + D(sf_i - sf_{i-1}) + R(h_{i-1}, h_i)) \leq B,$$

where $w_i$ is the weighting number of the $i^{th}$ scale factor band, $d_i$ is the quantization distortion of the $i^{th}$ scale factor band, $b_i$ is the bits for coding the quantized spectral coefficients, D is the differential coding function, $sf_i$ and $sf_{i-1}$ are the SF parameters of the $i^{th}$ scale factor band and the $i-1^{th}$ scale factor band, and $D(sf_i\text{-}sf_{i-1})$ is the bits for coding the scale factor of the $i^{th}$ scale factor band. R is the run-length coding function, $h_i$ and $h_{i-1}$ are the HCB parameters of the $i^{th}$ scale factor band and the $i-1^{th}$ scale factor band, $R(h_{i-1}, h_i)$ is bits for coding the Huffman codebook index of the $i^{th}$ scale factor band, and B is the prescribed bit rate.

The Lagrangian multiplier $\lambda$ can be added into the above formula when using the JTB optimization. It can be performed by minimizing the unconstrained cost function $C_{ANMR}$:

$$C_{ANMR} = \sum_i w_i d_i + \lambda \cdot (b_i + D(sf_i - sf_{i-1}) + R(h_{i-1}, h_i))$$

Because the JTB optimization will optimize the SF parameter and the HCB parameter at the same time, the amount of computation is $(60\times12)^2$. Hence, the fast bit allocation method for audio coding of the present invention, in the condition of using the predetermined HCB such as the virtual HCB model, first uses the Trellis-based method to optimize the SF parameter to obtain a set of optimized SF parameters, and then uses the optimized SF parameter and the Trellis-based method to optimize the HCB parameter to obtain a set of optimized HCB parameters. Hence, the present invention can significantly reduce the amount of computation for the bit allocation.

Hence, the above formula for the JTB optimization can be performed by minimizing the unconstrained cost functions $C_{SF_ANMR}$ and $C_{HCB}$:

$$C_{SF_ANMR} = \sum_i w_i d_i + \lambda \cdot (b_i + D(sf_i - sf_{i-1})),$$

$$C_{HCB} = \sum_i b_i + R(h_{i-1}, h_i).$$

Because this method only optimizes one parameter at a time, we call it a Cascaded Trellis-based (CTB) optimization. The amount of the computation is $60^2+12^2$ only. That is, the computation complexity of the CTB optimization is one one-hundred-fortieth of that of the JTB optimization.

In addition, when optimizing the MNMR, the following formula has to be satisfied:

$$\min\left(\max_i w_i d_i\right) \text{ such that } \sum_i (b_i + D(sf_i - sf_{i-1}) + R(h_{i-1}, h_i)) \le B.$$

The above formula for the JTB optimization can be performed by minimizing the unconstrained cost function $C_{MNMR}$:

$$C_{MNMR} = \sum_i (b_i + D(sf_i - sf_{i-1}) + R(h_{i-1}, h_i))$$

Likewise, the amount of the computation for JTB MNMR optimization is $(60\times12)^2$. Hence, the fast bit allocation method for audio coding of the present invention, in the condition of using the predetermined HCB such as the virtual HCB model, first uses the Trellis-based method to optimize the SF parameter to obtain a set of optimized SF parameter, and then uses the optimized SF parameters and the Trellis-based method to optimize the HCB parameter to obtain a set of optimized HCB parameters. Hence, the present invention can significantly reduce the amount of computation for the bit allocation.

Hence, the above formula for the JTB optimization can be performed in the condition of $w_i d_i \leqq \forall i$ by minimizing the unconstrained cost functions $C_{SF_MNMR}$ and $C_{HCB}$:

$$C_{SF_MNMR} = \sum_i b_i + D(sf_i - sf_{i-1}),$$

$$C_{HCB} = \sum_i b_i + R(h_{i-1}, h_i).$$

Because this method only optimizes one parameter at a time, we call it a Cascaded Trellis-based (CTB) optimization. The amount of the computation is $60^2+12^2$ only. That is, the computation complexity of the CTB optimization is one one-hundred-fortieth of that of the JTB optimization.

In addition, because the virtual HCB model is used to replace all HCB parameters when using the Trellis-based optimization, we can derive the simplified rules for selecting the candidate HCB parameter based on the statistics of data. We use them to estimate two important coefficients for the virtual HCB model, the coding bit deviation coefficient δ and the HCB weighting coefficient α. The formula for selecting the candidate HCB parameter is as follows:

$$h_{k,i}^{v} = \{n | H_n(q_{k,i}) \leqq \min_m\{H_m(q_{k,i})\} + \delta, n \in \{1, 2, \ldots, 12\}\} \quad (1)$$

First, we analyze all HCB and find out the minimum number of bits $\min_m\{H_m(q_{k,i})\}$ for coding the quantized spectral coefficients $q_{k,i}$. If the coding bits $H_n(q_{k,i})$ satisfies formula (1), the Huffman codebook n will be included in the virtual HCB $h_{k,i}^{v}$.

After using formula (1) to determine the virtual HCB $h_{k,i}^{v}$, we can use the formula (2) to estimate the quantized spectral coefficient bit $b_{k,i}$ for optimizing the SF parameter:

$$b_{k,i} = \frac{1}{|h_{k,i}^{v}|} \sum_{n \in h_{k,i}^{v}} H_n(q_{k,i}) + \alpha \cdot R_v(h_{l,i-1}^{v}, h_{k,i}^{v}) \quad (2)$$

where $$\frac{1}{|h_{k,i}^{v}|} \sum_{n \in h_{k,i}^{v}} H_n(q_{k,i})$$

is an average of total coding bits obtained by using all Huffman codebooks of the virtual Huffman codebook $h_{k,i}^{v}$, and $R_v(h_{l,i-1}^{v}, h_{k,i}^{v})$ is the run-length coding bit of the virtual Huffman codebook $h_{k,i}^{v}$ In light of the above, the fast bit allocation method for audio coding of the present invention is shown in FIG. 1. At step 110, a parameter δ is initialized. At step 120, the scale factor parameter is optimized using a Trellis-based method in a condition of using a predetermined Huffman codebook such as the virtual HCB model to obtain a set of optimized scale factor parameters. At step 130, the optimized scale factor parameter and the Trellis-based method are used to optimize the Huffman codebook parameter to obtain a set of optimized Huffman codebook parameters.

To compensate for the possible deviation of the scale factor parameter due to the use of the predetermined Huffman codebook, at step 140, the optimized Huffman codebook parameter is used to optimize the scale factor parameter for adjusting the optimized scale factor parameter. Of course, from the reduction of the amount of computation point of view, this step could be skipped.

Finally, at step 150, the optimized scale factor parameter and the optimized Huffman codebook parameter are used to calculate a total bit rate required for coding. At step 160, the total bit rate and the prescribed bit rate are compared. If the total bit rate is higher than the prescribed bit rate, at step 170, the parameter δ is adjusted. Then the procedure returns back to the step 110 and then repeats the above steps until the total bit rate is lower than or equal to the prescribed bit rate. Thus, the optimization is achieved.

The following table uses the AAC of MPEG-4 as an example to compare the computation complexity and the audio quality when using different algorithms in the condition that the prescribed bit rate is 64 kbps:

| | ANMR (dB) | MNMR (dB) | ODG*[1] | Computational complexity | Memory complexity |
|---|---|---|---|---|---|
| JTB-ANMR | −3.5998 | 2.2655 | −2.8703 | $(60 \times 12)^2$ | 60 × 12 |
| CTB-ANMR | −3.4512 | 2.3445 | −2.8761 | $60^2 + 12^2$ | 60 |
| JTB-MNMR | −2.2227 | −0.4287 | −3.0414 | $(60 \times 12)^2$ | 60 × 12 |
| CTB-MNMR | −2.1588 | −0.3515 | −3.0537 | $60^2 + 12^2$ | 60 |

*[1]ODG(Objective Difference Grade) is a method for evaluating the audio quality proposed by Draft ITU-T Recommendation BS.1387: "Method for objective measurements of perceived audio quality," July 2001. The score of ODG ranges from 0 to −4, wherein "0" means "imperceptible impairment" and "−4" means "impairment judged as very annoying". That is, the closer the score is to "0", the better the audio quality of the compressed audio data is.

JTB-ANMR uses the prior art of the JTB optimization to optimize ANMR.

CTB-ANMR uses the prior art of the CTB optimization of the present invention to optimize ANMR.

JTB-MNMR uses the JTB optimization to optimize MNMR.

CTB-MNMR uses the CTB optimization of the present invention to optimize MNMR.

Because in the JTB optimization of the prior art, each candidate SF parameter has 12 candidate HCB parameter, the computation complexity is $(60\times12)^2$. In the CTB optimization of the present invention, because the SF parameter and HCB parameter are optimized sequentially, each candidate SF parameter has one candidate HCB parameter during the optimization of the SF parameter and each candidate HCB parameter has one candidate SF parameter during the optimization of the HCB parameter. Hence, the computation complexity is $(60\times1)^2+(12\times1)^2$ only, which is one one-hundred-fortieth of that of the JTB optimization.

In addition, the memory requirement for the computation is proportional to the number of the candidates. Hence, the memory requirement for the CTB optimization is one twelfth of that for the JTB optimization. Further, based on the audio quality analyses of the ANMR, MNMR, and ODG criteria, the audio quality by using the CTB optimization of the present invention is very close to the audio quality by using the JTB optimization.

The above description provides a full and complete description of the preferred embodiments of the present invention. Various modifications, alternate construction, and equivalent may be made by those skilled in the art without changing the scope or spirit of the invention. Accordingly, the above description and illustrations should not be construed as limiting the scope of the invention which is defined by the following claims.

What is claimed is:

1. A fast bit allocation method for audio coding, comprising:

initializing a parameter;

using a Trellis-based method to optimize the scale factor parameter using the predetermined Huffman codebook to obtain a set of optimized scale factor parameters;

using said optimized scale factor parameter and said Trellis-based method to optimize the Huffman codebook parameter to obtain a set of optimized Huffman codebook parameters;

using said optimized scale factor parameter and said optimized Huffman codebook parameter to calculate the total bit rate required for coding; and adjusting said parameter when said total bit rate is higher than a predetermined bit rate.

2. The method of claim 1, further comprising:

using said optimized Huffman codebook parameter to optimize said scale factor parameter for adjusting said optimized scale factor parameter.

3. The method of claim 1, wherein said predetermined Huffman codebook is a virtual Huffman codebook model, said virtual Huffman codebook model using following formulas:

$$h_{k,i}^{v}=\{n|H_n(q_{k,i})\leq\min_m\{H_m(q_{k,i})\}+\delta\} \tag{1}$$

$$b_{k,i} = \frac{1}{|h_{k,i}^{v}|}\sum_{n\in h_{k,i}^{v}} H_n(q_{k,i}) + \alpha\cdot R_v(h_{l,i-1}^{v}, h_{k,i}^{v}) \tag{2}$$

where $\min_m\{H_m(q_{k,i})\}$ is a minimum number of bits required for coding the quantized spectral coefficients $q_{k,i}$, and said $\delta$ is a coding bit deviation parameter, wherein if the coding bits $H_n(q_{k,i})$ satisfies said formula (1), said Huffman codebook n will be included into said virtual Huffman codebook $h_{k,i}^{v}$; wherein $b_{k,i}$ is the bits for coding the quantized spectral coefficient, $$\frac{1}{|h_{k,i}^{v}|}\sum_{n\in h_{k,i}^{v}} H_n(q_{k,i})$$

is an average of total coding bits obtained by using all Huffman codebooks of said virtual Huffman codebook $h_{k,i}^{v}$, $R_v(h_{l,i-1}^{v},h_{k,i}^{v})$ is a coding bit of said virtual Huffman codebook $h_{k,i}^{v}$, and $\alpha$ is a virtual Huffman codebook weighting parameters.

4. The method of claim 1, wherein said step of using the said Trellis-based method to optimize said scale factor parameter is for minimizing an unconstrained cost function $C_{SF_ANMR}$:

$$C_{\mathrm{SF_ANMR}} = \sum_i w_i d_i + \lambda\cdot(b_i + D(sf_i - sf_{i-1})),$$

where $w_i$ is a weighting number of the $i^{th}$ scale factor band, $d_i$ is a quantization distortion of the said $i^{th}$ scale factor band, $\lambda$ is a Lagrangian multiplier, $b_i$ is the bits for coding the quantized spectral coefficients, and $D(sf_i-sf_{i-1})$ is the bits for coding the scale factor of the said $i^{th}$ scale factor band.

5. The method of claim 4, wherein said step of minimizing said unconstrained cost function $C_{SF_ANMR}$ comprises a Viterbi search procedure.

6. The method of claim 1, wherein said step of using said optimized scale factor parameter and said Trellis-based method to optimize said Huffman codebook parameter to obtain said optimized Huffman codebook parameter comprises minimizing an unconstrained cost function $C_{HCB}$:

$$C_{HCB} = \sum_i b_i + R(h_{i-1}, h_i),$$

where $b_i$ is bits for coding the quantized spectral coefficients, and $R(h_{i-1},h_i)$ is bits coding the Huffman codebook index of said $i^{th}$ scale factor band.

7. The method of claim 6, wherein said step of minimizing the said unconstrained cost function $C_{HCB}$ comprises a Viterbi search procedure.

8. The method of claim 1, wherein said step of using said Trellis-based method to optimize the said scale factor parameter comprises minimizing a cost function $C_{SF_ANMR}$ under a condition of $w_i d_i \leqq \forall i$:

$$C_{\mathrm{SF_MNMR}} = \sum_i b_i + D(sf_i - sf_{i-1}),$$

where $w_i$ is a weighting number of an $i^{th}$ scale factor band, $d_i$ is a quantization distortion of the said $i^{th}$ scale factor band, $\lambda$ is a Lagrangian multiplier, $b_i$ is bits for coding the quantized spectral coefficients, and $D(sf_i\text{-}sf_{i-1})$ is bits for coding the scale factor of said $i^{th}$ scale factor band.

9. The method of claim 8, wherein said step of minimizing said cost function $C_{SF_MNMR}$ comprises a Viterbi search procedure.

* * * * *